US006405769B1

(12) United States Patent
Labrie

(10) Patent No.: US 6,405,769 B1
(45) Date of Patent: Jun. 18, 2002

(54) MATERIAL-RECOVERY APPARATUS

(76) Inventor: Thom L. Labrie, 57 Labrie La., Greene, ME (US) 04236

( * ) Notice: Subject to any disclaimer, the term of this patent is extended or adjusted under 35 U.S.C. 154(b) by 0 days.

(21) Appl. No.: 09/917,031

(22) Filed: Jul. 27, 2001

(51) Int. Cl.[7] ..... B27M 1/08; B27B 31/00

(52) U.S. Cl. ..... 144/3.1; 144/3.1; 144/114.1; 144/242.1; 144/246.1; 144/247; 144/248.4; 144/250.13; 144/373; 144/377; 144/39

(58) Field of Search ..... 144/1.1, 3.1, 36, 144/39, 114.1, 134.1, 127.1, 218, 359, 376, 242.1, 246.1, 250.13, 250.16, 248.4, 247, 373, 377

(56) References Cited

U.S. PATENT DOCUMENTS 3,780,778 A * 12/1973 Chapman ..... 144/39
4,335,767 A * 6/1982 Reuter ..... 144/3.1

* cited by examiner

*Primary Examiner*—W Donald Bray
(74) *Attorney, Agent, or Firm*—Thomas L. Bohan; Patricia M. Mathers

(57) ABSTRACT

Material-recovery apparatus for obtaining usable, uniformly-dimensioned blanks from scrap. Apparatus is small, and economical in manufacture and operation, using only a single lifting jack and vertical support unit to support the tool-and-feed-roller housing. Feed-roller tensioning units for exerting downward force on rollers have a spring-biased bell-crank mechanism.

15 Claims, 8 Drawing Sheets

MATERIAL-RECOVERY APPARATUS

BACKGROUND INFORMATION

1. Field of the Invention

The invention relates to the field of material-recovery operations. More particularly, the invention relates to the recovery of valuable, usable material from under-utilized and waste-stream material. More particularly yet, the invention relates to the use of material-removing tools in the recovery of usable material from under-utilized and waste-stream material of various shapes and sizes.

2. Description of the Prior Art

Inherent in a manufacturing process is that one or more products are produced according to specifications that define the shape and size of the product, that is, that each exemplar of the product produced by a particular process ideally has a shape and size according to the applicable specification. A particular problem in a manufacturing process in which an exemplar of a product is cut or otherwise produced by a material-removing process is that the material that is left over may have a shape or size that renders it useless for obtaining any more exemplars of the particular product according to specification, though it may contain sufficient material to provide one or more different products. In spite of such collateral use, such left-over material is normally deemed to be scrap and channeled into a waste-material stream in which the material is converted into a low-value chip or mulch by-product, discarded as waste into a landfill, or perhaps burned for fuel.

A sawmill is a typical example of a manufacturing operation that generates left-over material that may be useful material for other operations. The mill takes round logs, often with the bark still attached, and converts them into square and rectangular products. In the sawing process, material forming the outside perimeter of each log ends up as irregularly shaped slabs, edgings, and waney material of random thickness and/or width. The term "waney" as used hereinafter refers to stock or material that has waning, i.e., diminishing, dimensions, such as presented by a tapered piece of wood. Such waney material, however, often contains enough wood from which to obtain one or more pieces of a high-value product, such as uniformly dimensioned stock or blanks for turning or component stock. Although this material is potentially valuable, the sawmill owner is not interested in working with it, as the sawmill is not equipped for processing small pieces of short and/or irregularly shaped wood.

Wood is used in this discussion to illustrate the generation of material that is "scrap" for one particular type of manufacturing operation and a high-value material for another operation. It should be understood, however, that any material-removing process used to create a product will also produce a "scrap" material that may be remaindered, i.e., declared a left-over, material that is valuable and usable for manufacturing other high-value products. Hereinafter, "scrap" material that is usable to create other products will be referred to as "remaindered material". It should also be understood that, although wood is the material most commonly referenced herein as "the material", other substances exist that can be used in a material-removing process to form articles or products. These include plastic materials, hard rubber, etc., are therefore also included in the definition of remaindered material in the following discussion of material-recovery operations.

Until now, it has been quite costly to process remaindered material because of the fact that the traditional approach requires several types of machines and several labor-intensive operations to process irregularly shaped pieces of material coming in a range of thicknesses, widths, and lengths, so as to render it useful. As a result, such remaindered material often flows into a waste-material stream or is chipped and burned as fuel. This is not only wasteful in terms of responsible use of natural resources, but cost-ineffective for several reasons.

The wood that is left over after the sawing or other material-removing processes is generally very expensive wood when valued on a cost-per-unit-weight or cost-per-unit-volume basis. Not only is the wood contained in this remaindered material generally jacket wood, i.e., the outer layer of wood on a tree, and the highest quality wood in the tree, it has also passed through one or more processing operations and has been handled extensively. It is economically wasteful not to extract as much value as possible from it. It is an irony that the very wood that is most desirable for manufactured wood products is being discarded as scrap for lack of a cost-effective, efficient way of extracting valuable, usable material from it.

Some manufacturers try to obtain at least some value for the wood left over from the material-removing processes by selling it as fuel, mulch, and/or paper chips. Using remaindered material as fuel has the disadvantage that the material has to be transported to the site where it is chipped and/or burned, thereby further reducing its already nominal value as fuel. Furthermore, there is a limit to the demand for products made from chipped wood fiber. For those reasons and the fact that there is an ever-increasing production of wood chips, chips are becoming less and less valuable as a by-product of wood-processing operations.

Manufacturers have for years attempted to solve the problems inherent in the utilization of remaindered wood, only to discover that it is simply not economically feasible to process material that comes in a range of widths, thicknesses, lengths, or irregular shapes. Such material requires multiple handling and processing steps to convert it into a more workable uniform and valuable product. The only known apparatus on the market for easily and economically converting scrap wood to usable dimensioned stock is a machine designed and constructed by the inventor of the present invention and that has been available for several years. This machine, the YIELD PRO Recovery machine, converts slabs, sawmill and ripsaw edgings, waney stock, and other mis-sized or random-shaped materials into uniform square-edged stock. The YIELD PRO Recovery machine is a large and rugged machine that has separate tool spindles and motors for the horizontal cutting tool and the vertical cutting tool, respectively, a lifting jack with several linear guides on each side of it, as well as a third motor for driving conveyors. This machine is capable of processing slab wood of sizes up to 4" by 12", can remove up to one inch of material from the top, and can even process material that has nails embedded in it. Because of its ruggedness, however, and its ability to handle large pieces of wood, this high-volume machine is relatively costly to manufacture and, thus, to acquire. Furthermore, because of its relatively large footprint, requires a lot of floor space.

Primary operations in the wood-products industry include such operations as sawing boards from logs in sawmills; secondary operations include such operations as turning round stock and cutting relatively small component pieces. Although primary operations are the largest source of remaindered material suitable for recovery processes, secondary operations such as furniture-making also provide significant amounts of remaindered material suitable for recovery. Currently, the remaindered material from secondary operations, as well as from primary operations, is treated as waste material and is funneled into the waste stream to be chipped and/or burned.

The remaindered material from secondary operations is generally even more valuable then that from primary operations. For example, in furniture-making operations, the material is likely to be kiln-dried wood that has been through any number of shaping and forming operations. The particular difficulty with recovering usable material from the remaindered material from secondary operations is that the dimensions of this material are typically much smaller than the remaindered material generated by primary operations. On the other hand, a machine that is as rugged as the YIELD PRO Recovery machine described above is not necessary to process the remaindered material generated by secondary operations. For example, wood from furniture-making operations will not have nails embedded in it; also, such wood will not be covered with bark and, therefore, less material will need to be removed from the top. Furthermore, remaindered material from secondary operations will also generally be shorter in length than much of the remaindered material from a sawmill.

For these reasons, a machine that is less expensive to manufacture and that is small enough that it can be moved around to different work stations in a plant, and that requires less energy to operate, will be more desirable to potential buyers and, therefore, pose a lower threshold for manufacturers to overcome if they are otherwise enticed by economics and/or environmental or other concerns to recover more material for higher value-uses than the burning of it for fuel.

One aspect that is critical to proper operation of the material-recovery apparatus is its feed system. When material is fed into a machine to be cut by material-removing tools, the tendency is for the material to be kicked back from the rotating cutters that resist the advance of the material. For this reason, the feed conveyor is provided with a surface that prevents material from slipping in the direction opposite to the feed direction, and feed rollers are mounted on the machinery to keep the material pressed against the conveyor. The feed rollers on the conventional machinery are attached to bearing-mounted tensioning units that apply a downward biasing force to the feed rollers. When the material feeds into the machine, these feed rollers are forced upward against the biasing force by the in-feeding material. The apparatus is designed so that the rollers accommodate the material, yet maintain sufficient downward force on it to ensure that it is carried into the cutting tools. Conventional tensioning units use a bearing-mounted spindle, around which a tensioning spring is coiled. A disk having a plurality of evenly-spaced holes around its outer perimeter is mounted at one end of the tensioning spindle. By turning the disk and inserting a locking pin into one of the holes, one moves the disk so as to bias it to apply a torque in one direction, while it remains free to rotate in the opposite direction if a force strong enough to overcome the biasing torque is applied to it. The disadvantage of the conventional tensioning unit is that, because of the machining and the amount of material necessary to provide a secure mount, it is quite expensive to manufacture.

What is needed, therefore, is material-recovery apparatus that is easy to operate, readily portable, and relatively inexpensive to manufacture. What is further needed is such apparatus that will accept material of various widths, thicknesses, lengths, and irregular shapes, and produce a square-edged product with a single pass of the material through the apparatus. What is yet further needed is such apparatus that is easily adjustable so as to produce square-edge stock in a range of sizes and relative dimensions. And, finally, what is needed is such apparatus that requires less power to operate and less maintenance.

BRIEF SUMMARY OF THE INVENTION

For the above-cited reasons, it is an object of the present invention to provide material-recovery apparatus that is mechanically uncomplicated, easily portable, economical to manufacture, and that requires a minimum time for set-up and maintenance. It is a further object to provide such apparatus that can accept material of various dimensions and irregular shapes and produce a square-edged product with a single pass of the material through the apparatus. It is a yet further object to provide such apparatus that is easily adjustable and can produce square-edged product in a range of varying dimensions.

The objects are achieved by providing material-recovery apparatus that is small in size and light enough to be easily portable, is made up of mechanically simple components, is energy-efficient and versatile, requires little effort to set up, operate, and maintain, and that produces uniform dimensioned stock from remaindered material of irregular dimensions and shapes. The apparatus according to the invention has a single tool spindle driven by a single motor. The single spindle supports two cutting tools that perform two different machining tasks simultaneously—the planing of the top face and the sawing of the outside edge of the material being processed. As the remaindered material is fed into the apparatus, feed rollers placed before and after the tool spindle bear down on the material and press it against a feed conveyor that forces it through the cutting operation.

The referenced feed rollers are forced down against the material on the conveyor by tensioner units that are designed so as to allow the rollers to adapt to varying thicknesses of an in-feeding workpiece while yet reliably holding the workpiece against the feed conveyor for feed and cutting operations. These tensioner units are the heart of the invention and are quite different from their counterparts in the Yield Pro prior art. Each tensioner unit is constructed of simple components that make it less expensive to construct than the known bearing-mounted tensioner units. Furthermore, the new tensioner unit according to the invention is easy to maintain and is effective in applying a downward pressure onto the workpiece feeding into the cutting operation, even if the workpiece varies in thickness and shape, or each workpiece varies from the others being processed.

Remaindered material such as that produced in a sawmill or in a plant that produces moldings or blanks for round stock—for example, broom handles or dowels—includes pieces of slab wood, waney stock that has a diminishing dimension such as thickness or width or both, edgings, irregularly shaped pieces such as molding, and wood that has an unacceptable or unworkable section. Generally, such remaindered material has two flat faces that intersect perpendicularly to one another. It is this type of material that can be processed into usable stock with a single pass through the apparatus according to the present invention. Remaindered material that has only one flat surface requires two passes through the apparatus to produce four-sided square-edged stock.

One of the key features of the new recovery apparatus is its simplicity. As mentioned above, it requires but a single-spindle machine driven by a single motor. Horizontal and vertical cutting tools are mounted on this single tool spindle to provide simultaneously two right-edged cuts along the top and the left vertical surface, respectively, of the workpiece fed through the apparatus. The housing that supports the feed rollers and the tool spindle of the new apparatus is shorter than that of the prior art and is supported, guided, and horizontally balanced by a single lifting jack, without linear guides.

DETAILED DESCRIPTION OF THE INVENTION

Figure 1A:
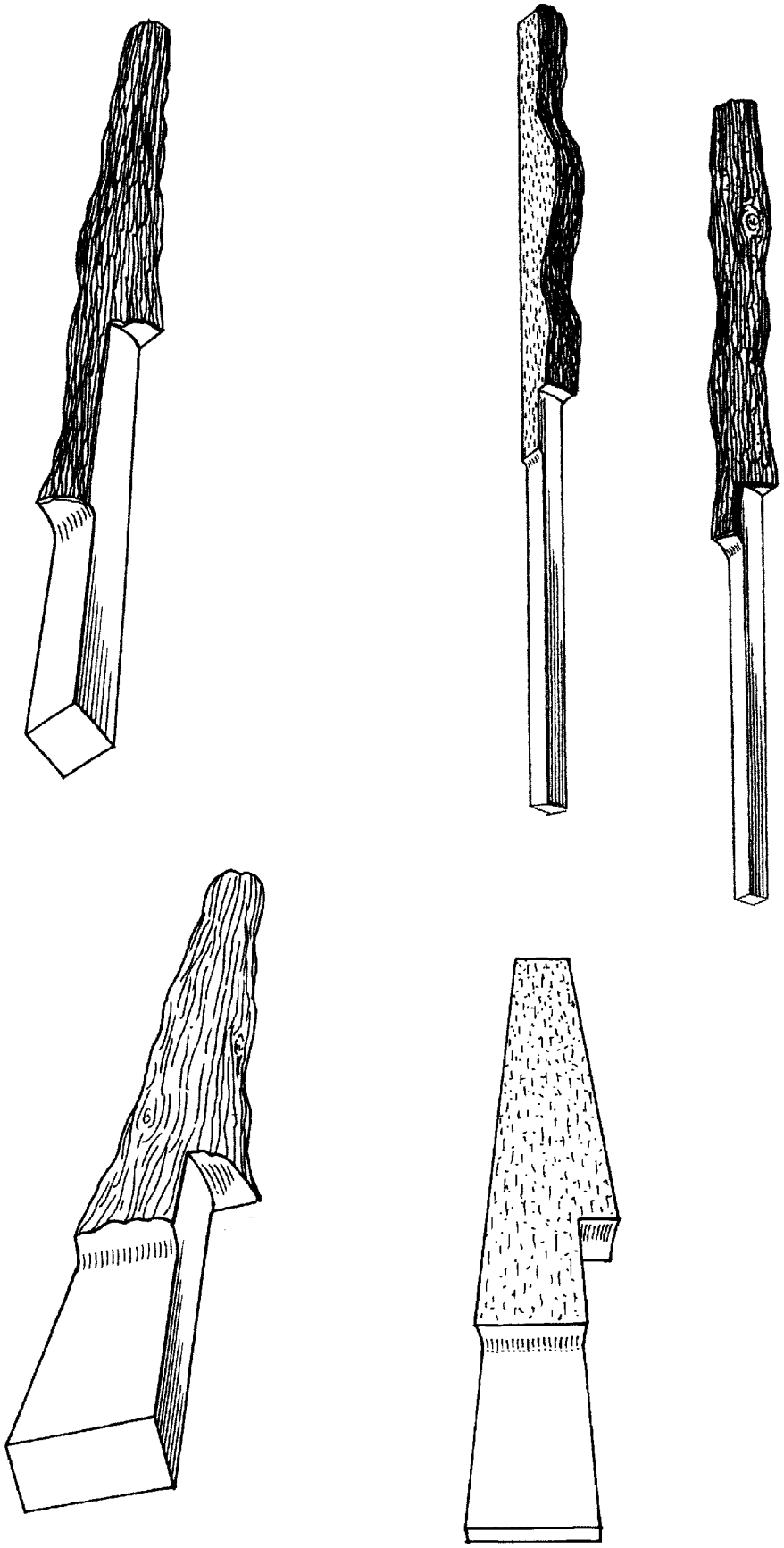
FIG. 1 illustrates the recovery of valuable blanks from some exemplar workpieces of remaindered material by a single pass of the remaindered material through the Preferred Embodiment of the apparatus.
FIG. 1B illustrates the recovery of valuable blanks from some exemplar workpieces of remaindered material that require two passes of the remaindered material through the Preferred Embodiment of the apparatus.
Figure 1B:
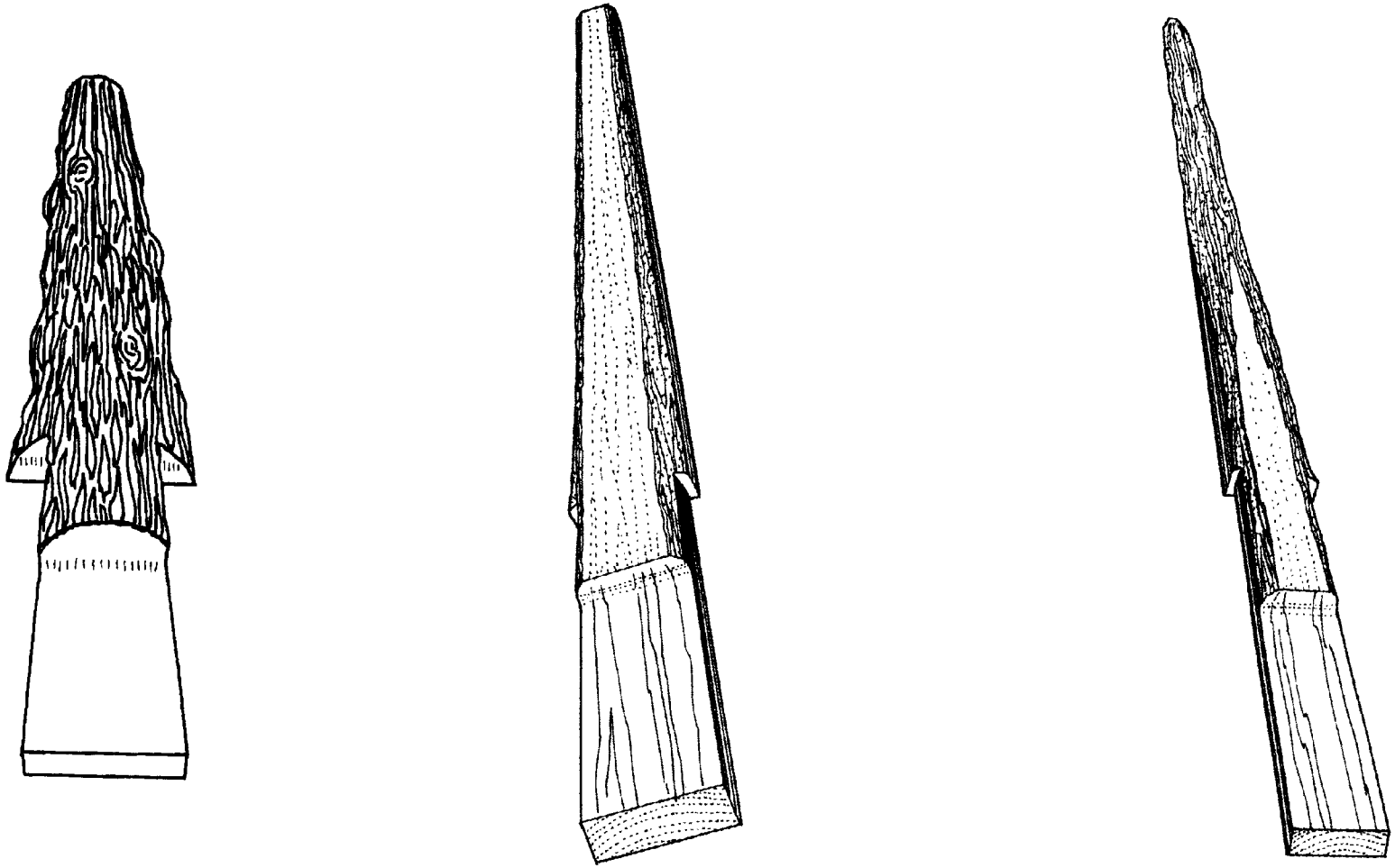

FIGS. 1A and 1B illustrate some of the types and shapes of remaindered material that can be converted into the usable blanks or stock by the apparatus of the present invention. As shown in FIGS. 1A and 1B, the remaindered material includes wood that is irregular in shape, that has an outer surface of bark, or is what is called "waney" stock, that is, wood having one or more dimensions that vary along the piece. FIG. 1A shows material that, prior to processing through the apparatus of the present invention, has two flat sides that are perpendicular to each other. This will allow usable blanks to be recovered from remaindered material in a single operation. Material shown in FIG. 1B has initially only one flat surface and will have to be processed in a two-step operation to convert it into rectangular blanks. Each of the recovered blanks shown in FIGS. 1A and 1B are uniform in dimensions and can be used to produce rectangular-dimensioned lumber or turned to produce spindles, dowels, handles, etc.

Figure 2:
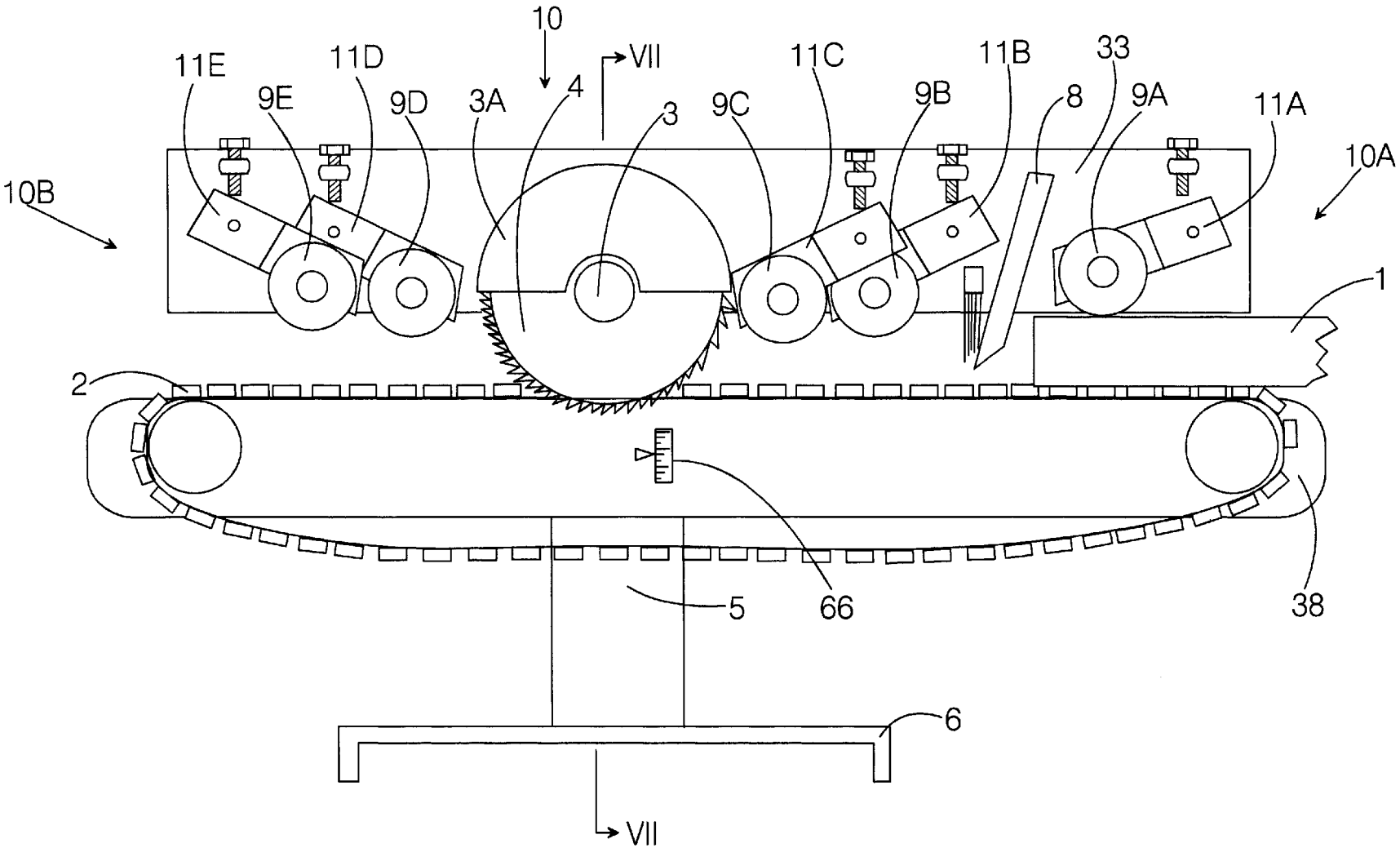
FIG. 2 is a schematic illustration of the Preferred Embodiment of the apparatus according to the present invention.

FIG. 2 is a schematic diagram of a recovery apparatus 10 according to the present invention. The recovery apparatus 10 comprises a machine base 6, a single lifting jack and stabilizing guide assembly 5, a housing 33 and a support bed 38. A feed conveyor 2 is mounted on the bed 38. A waste conveyor 7 is mounted on the bed 38 and runs alongside the feed conveyor 2. For purposes of illustration, the waste conveyor 7 is not shown in FIG. 2, but can be seen in FIG. 4. A tool spindle 3, feed rollers 9A . . . 9E and torque levers 11A . . . 11E are mounted on the housing 33. In the Preferred Embodiment of the recovery apparatus 10, each one of the feed rollers 9A . . . 9E is attached to a respective one of the five torque levers 11A . . . 11E and spaced along the recovery apparatus 10 between an input end 10A and an output end 10B of the recovery apparatus 10 so as to hold a workpiece 1 firmly in place as it is fed through the cutting operation and conveyed to the output end 10B. Each of the feed rollers 9A . . . 9E is adjusted to apply a downward pressure to the workpiece 1 to keep it pressed against the feed conveyor 2 and prevent it from resisting travel under cutting tool mounted on the tool spindle 3. In the Preferred Embodiment, the three rollers 9A–9C on the input end 10A of the recovery apparatus are adjusted so that the distance between the feed conveyor 2 and the bottom of each feed roller is increasingly smaller the closer each feed roller 9A–9C is to the tool spindle 3.

In the Preferred Embodiment, the first feed roller 9A has a larger diameter than the remaining feed rollers 9B–9E and exerts the greatest amount of downward force on the workpiece 1. The larger diameter provides a more advantageous ratio of the horizontal to vertical force components exerted on the first feed roller 9A when the workpiece 1 is initially fed into the recovery apparatus 10. In other words, because of the more gradual curvature of the larger diameter, the operator must apply less horizontal force to the workpiece 1 to force this first feed roller 9A in a vertical direction than if it had a smaller diameter. The greater downward force of the first feed roller 9A is required to provide sufficient traction of the workpiece 1 on the feed conveyor 2 to prevent the workpiece 1 from resisting forward feed. The remaining feed rollers 9B–9E can be smaller in size and apply less force to the workpiece 1, as they are operating either in cooperation with other feed rollers or, in the case of the fifth feed roller 9E, do not need to apply force to the workpiece 1 to force it under another roller.

Figure 3:
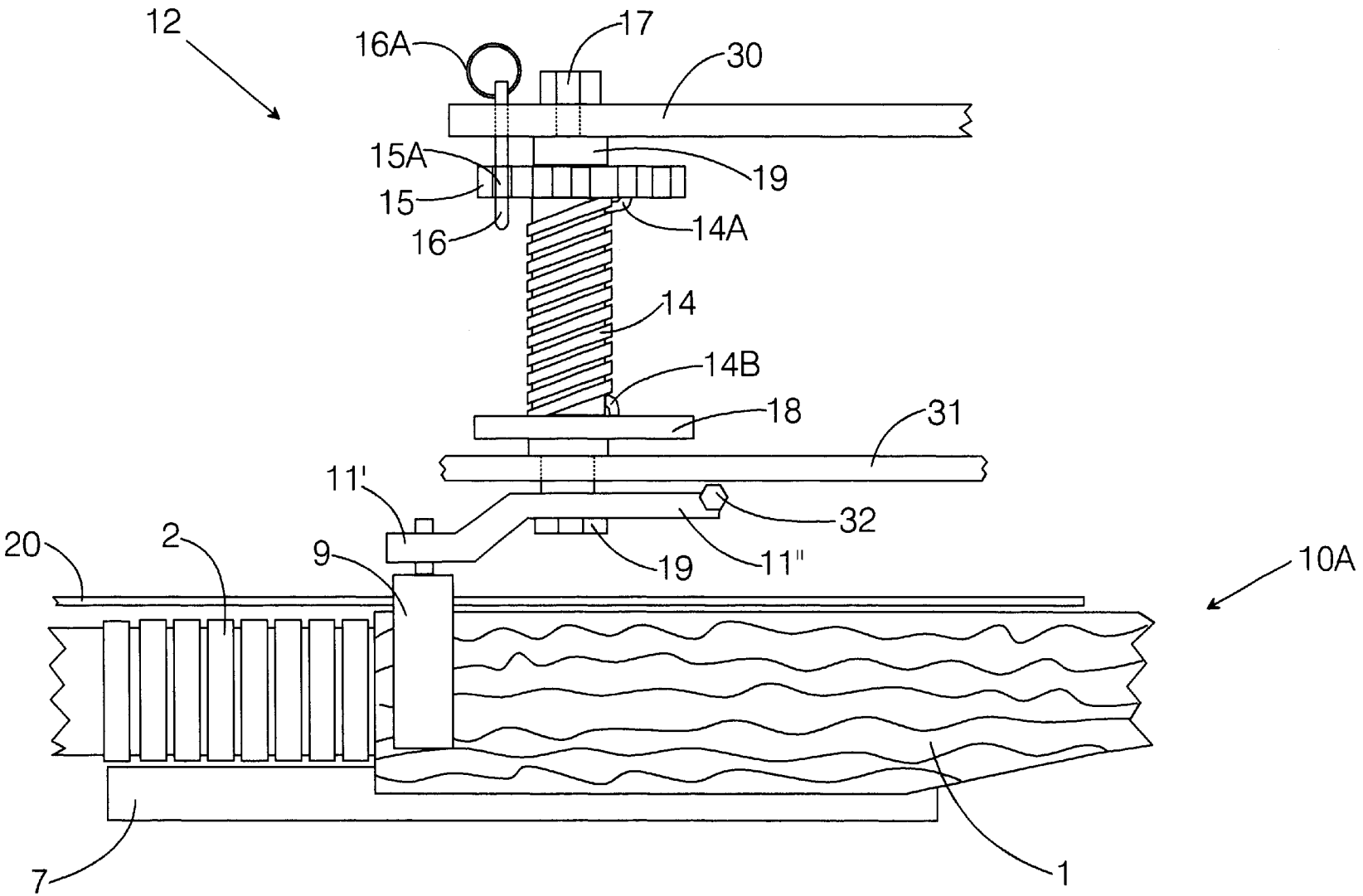
FIG. 3 is a plan view of one feed roller and tensioner unit of the Preferred Embodiment according to the invention.

FIG. 3 shows a feed roller 9 and a torque lever 11 that are representative of the feed rollers 9A . . . 9E and torque levers 11A . . . 11E, respectively. A tensioner unit 12 includes the torque lever 11, a torque spring 14 wound around a tensioner shaft 19, a tensioning disc 15, and a tensioner unit mounting plate 18. Grooves 15A, sized to receive a locking pin 16, are arranged around the outer circumference of the tensioning disc 15. The torque spring 14 has a first spring end 14A that is fixedly attached to the tensioning disc 15 and a second spring end 14B that is fixedly attached to the tensioner unit mounting plate 18. The feed roller 9 has a roller end 9' that is rigidly and fixedly attached to the torque lever 11 at a first end 11' of the torque lever 11. In the Preferred Embodiment, the tensioner shaft 19 extends through a first wall 30 of the housing 33 (shown in FIG. 4) and is rigidly and fixedly attached to an adjusting device 17. The adjusting device 17 in the Preferred Embodiment is a hexagonal head that can be grasped and turned with a wrench.

The tensioning disc 15 rotates freely about the tensioner shaft 19. When the adjusting device 17 is turned in a counterclockwise direction, the spring 14 is wound tighter about the tensioner shaft 19 and exerts a biasing torque on the tensioner unit mounting plate 18 and on the feed roller 9, pressing the feed roller 9 downward. When the desired amount of torque is applied to the feed roller 9, the locking pin 16 is inserted through an appropriately sized aperture in the first wall 30 and seated in one of the grooves 15A on the tensioning disc 15, thereby preventing the tensioning disc 15 from unwinding about the tensioner shaft 19 and relieving the torque that is applied to the feed roller 9.

Figure 4:
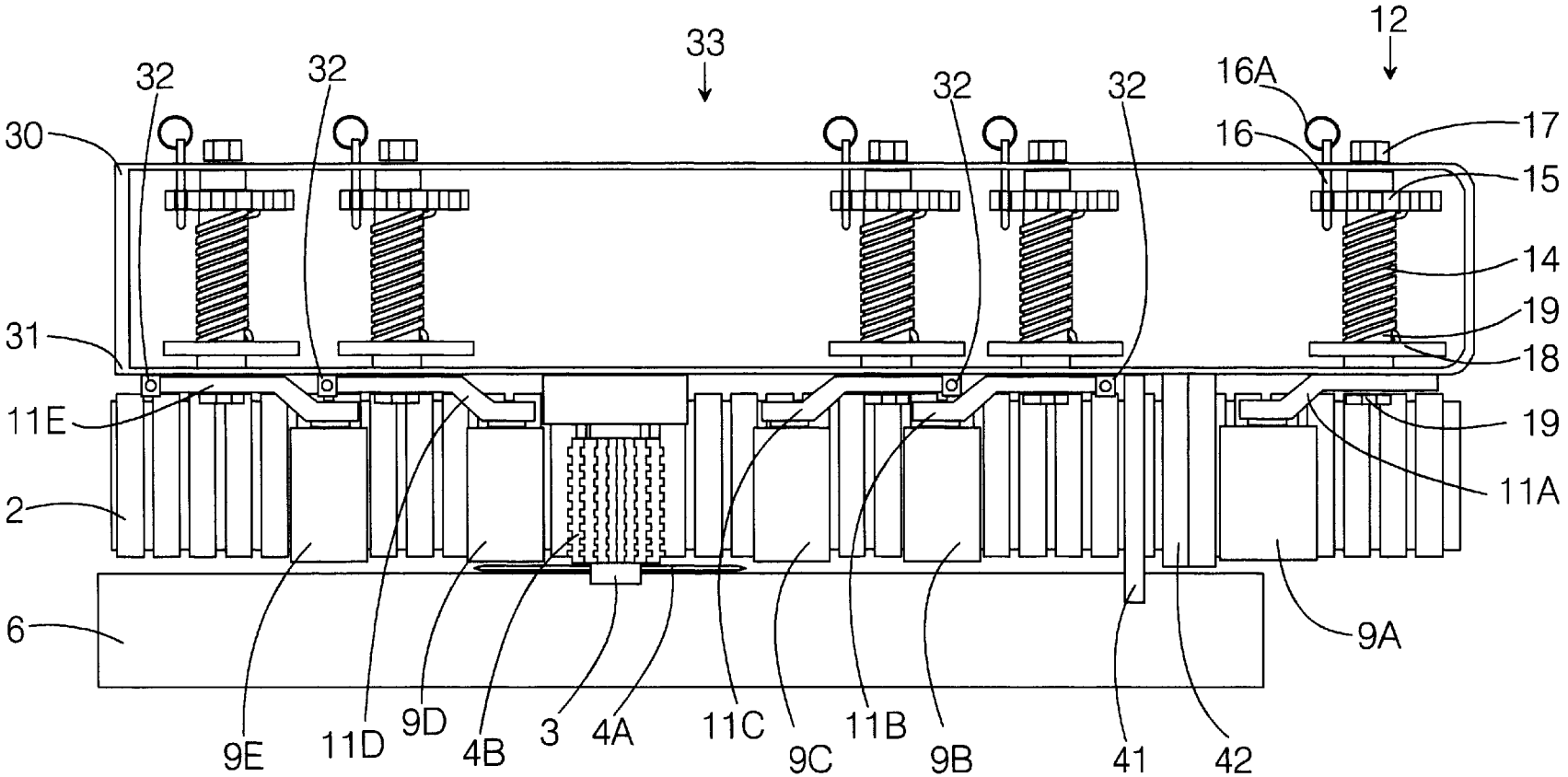
FIG. 4 is an illustration of the tensioner unit of the Preferred Embodiment according to the present invention.

FIG. 4 shows the housing 33, the tensioner units 12, the feed rollers 9A–9E, the torque levers 11A–11E, the feed conveyor 2, the waste conveyor 7, the tool spindle 3, a vertical cutting tool 4A and a horizontal cutting tool 4B. Also indicated in FIG. 4 is the placement of a dust curtain 41 and an anti-kickback shield 42. The dust curtain 41 is a wire mesh curtain that aids in retaining the dust in an area that is cleaned by a dust evacuation system. The curtain 41 and anti-kickback shield 42 are devices that are well-known in the field and are not described here in detail. Also, the dust evacuation system is provided by the operator of the recovery machine and is not included within the scope of the invention.

Figure 4A:
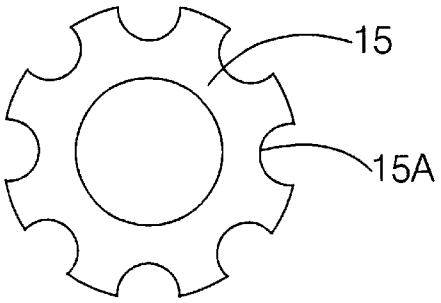
FIG. 4A is an elevational view of the tensioner disc of the Preferred Embodiment according to the invention.

FIG. 4A shows the tensioning disc 15 in detail. The disc 15 is mounted on the tensioner shaft 19 and grooves 15A are evenly spaced around the outer perimeter of the disc 15.

Figure 5:
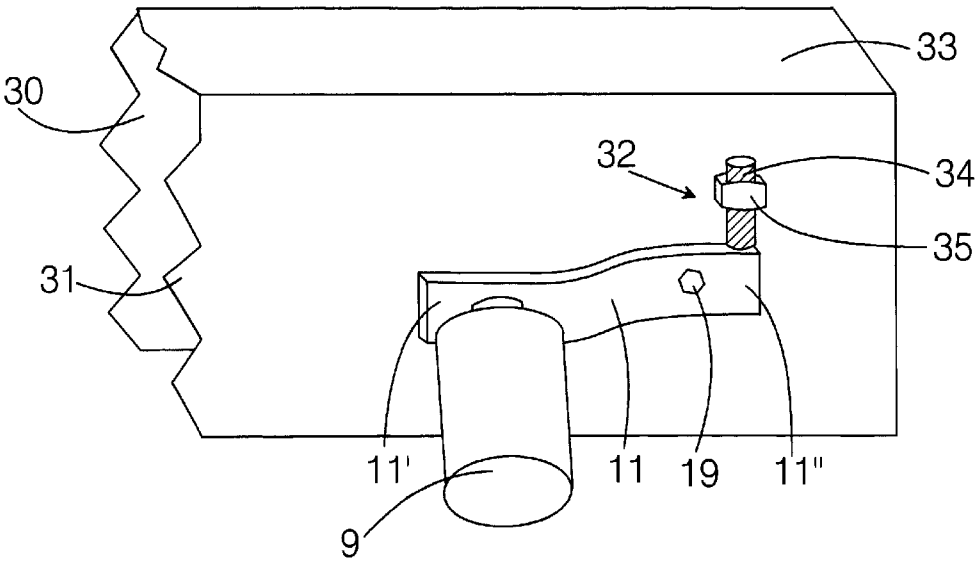
FIG. 5 shows the Preferred Embodiment of the height limiting device according to the invention.

FIG. 5 shows a height limit device 32 that is mounted on the second wall 31 of the housing 33 and limits the amount of downward force applied to the feed rollers 9. In the Preferred Embodiment, the height limit device 32 includes a threaded rod 34 that is threaded through a threaded bore in a bolt 35 that is rigidly and securely fastened to the second wall 31 of the housing 33. The threaded rod 34 can be adjusted so that the lower end of the rod 34 is higher or lower. The torque lever 11 is a rigid, non-flexible device, and thus, as greater torque is applied to the torque lever 11, the first end 11' of the torque lever 11 is forced downward and, consequently, the second end 11" forced upward. The threaded rod 34 is adjusted such that it prevents the second end 11" of the torque lever 11 from swinging upward past a certain distance and thereby applying too great a downward force to the feed roller 9, which, in turn, may prevent the workpiece 1 from traveling forward into the cutter blades.

Figure 6:
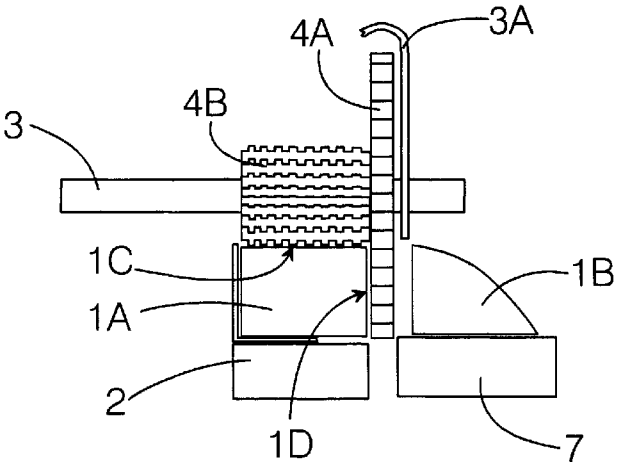
FIG. 6 illustrates the production of a square-edged blank in a single pass through the Preferred Embodiment of the material-recovery apparatus of the invention.

FIG. 6 is an elevational view of the tool spindle 3, the vertical side cutter 4A, the horizontal top cutter 4B, and the cutter shield 3A. As can be seen, the workpiece 1, an irregularly-shaped piece, is moving past the cutting tools 4A and 4B which are cutting a horizontal top surface 1C and a vertical side surface 1D to form a new blank 1A. The new blank 1A is carried through the recovery apparatus 10 to the output end 10B on the feed conveyor 2. At the same time, scrap material 1B left over after the cut is carried away on the waste conveyor 7.

Figure 7:
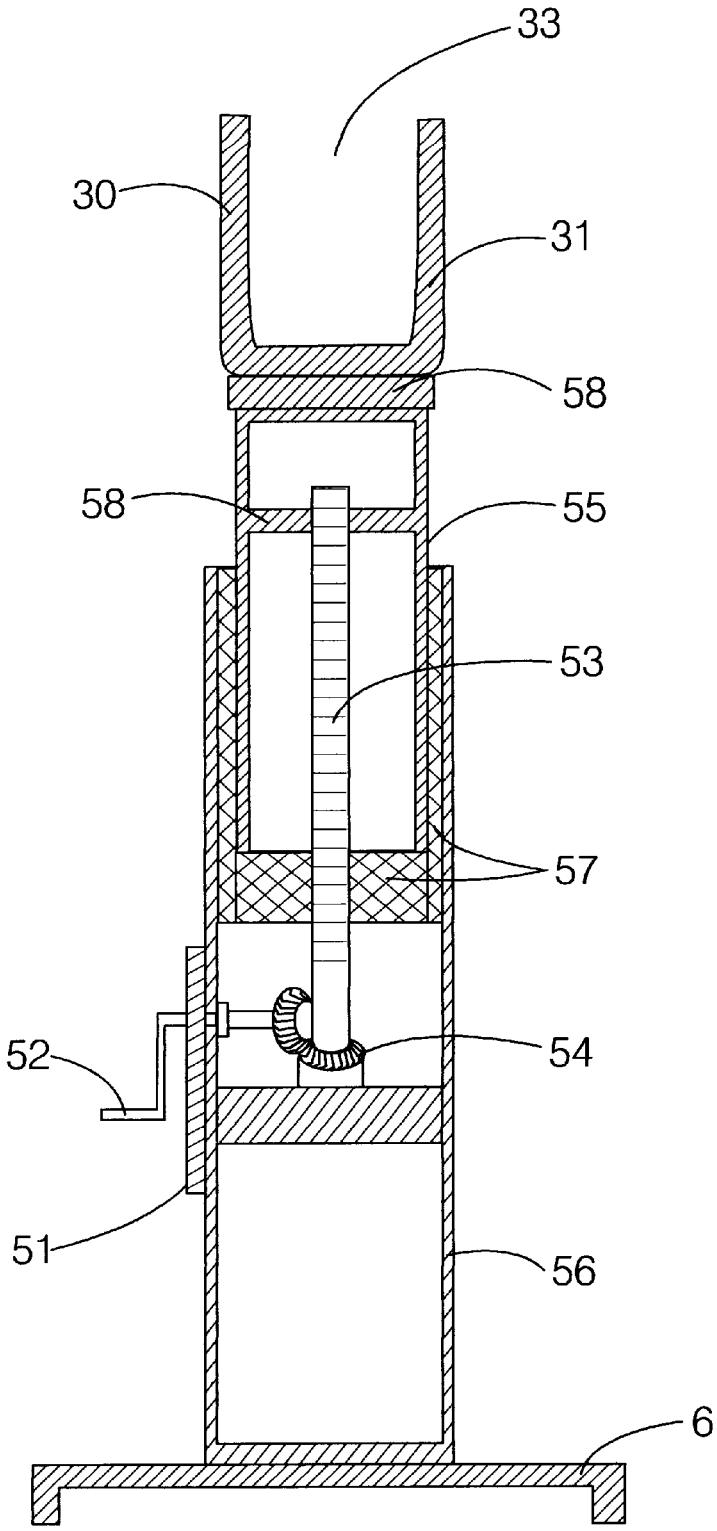
FIG. 7 is an illustration of the single lifting jack of the Preferred Embodiment according to the invention.

FIG. 7 shows a cross-sectional view of the single lifting-jack and stabilizing guide assembly 5 as indicated by the cut-line VII in FIG. 2. The lifting jack and stabilizing guide assembly 5 connects the housing 33 with the bed 38 of the recovery apparatus 10 and is used to adjust the height of the housing 33 to obtain a specified thickness of stock at the output end 10B of the recovery apparatus 10. As can be seen in FIG. 7, a threaded rod 53 is fixedly mounted in one of a pair of bevel gears 54. The other bevel gear is attached to a mounting plate 51 that is mounted on the outside of an outer tube 56. Connected to the pair of bevel gears 54 is a crank handle 52, which, when turned, causes the threaded rod 53 to rotate. The upper end of the threaded rod 53 is threaded through a bore in a stabilizing nut 58 that is fixedly mounted on the inside of an inner tube 55. The inner tube 55 and the housing 33 are fixedly and rigidly connected to each other by means of a bearing plate 61. When the threaded rod 53 rotates, the inner tube 55 is raised or lowered, thereby adjusting the vertical distance between the tool spindle 3 and the bed 38 and, thus, the feed conveyor 2. A vertical scale 66 is mounted on the bed 38 to indicate the final thickness of the workpiece 1 after it has passed the horizontal tool 4B.

In order to ensure that the horizontal and vertical. cuts on the workpiece 1 are square-edged, that is, perpendicular to one another, it is critical that the bed 38 and the housing 33 be held in perfect alignment relative to one another. This is achieved by supporting the inner tube 55 on a plastic poured bearing 57 that is poured into the outer tube 56. The bearing 57 provides sufficient clearance between the bearing surface and the inner tube 55 to allow the inner tube 55 to slide along the bearing 57, yet is close enough to the inner tube 55 to maintain perfect alignment of the inner tube 55 with the outer tube 56. The length of the recovery apparatus 10 in the Preferred Embodiment is short enough so that the bed 38 is not cantilevered a distance that requires additional support and leveling mechanisms other than the poured bearing 57 in the lifting jack and stabilizing assembly 5.

The lifting jack and stabilizing guide assembly 5 of the Preferred Embodiment is strictly manually powered, that is, is operated by means of the crank handle 52, without any pneumatic and hydraulic power-assists. This is primarily for reasons of economy. Indeed, the Preferred Embodiment of the recovery apparatus 10 is a small-sized machine that accepts a workpiece up to eight inches in width by two and one-half inches in thickness. Because of the small size of the Preferred Embodiment of the recovery apparatus 10, it is not necessary to provide power assistance for lifting. It is, of course, possible, to equip the recovery apparatus 10 according to the invention with a pneumatic or hydraulic power-assisted lifting jack and stabilizing guide assembly 5 and this may be desirable if pneumatic or hydraulic power is already available at the site where the recovery apparatus 10 is installed.

Figure 8:
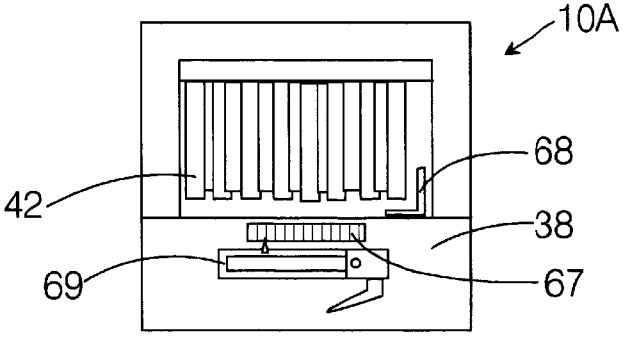
FIG. 8 shows the input end of the Preferred Embodiment of the apparatus according to the invention.

FIG. 8 shows an input end 10A of the recovery apparatus 10 according to the invention. In the Preferred Embodiment, the input end 10A is enclosed for safety reasons. A fence guide 68 is movably mounted on the bed 38. Mounted on the enclosure is a mechanical cam locking device 69 with handle that is used to adjust the finish width, that is, the horizontal distance between the vertical cutter 4A and the fence guide 68. A horizontal scale 67 is mounted on the bed 38 to indicate the finish width of the workpiece 1.

Figure 9A:
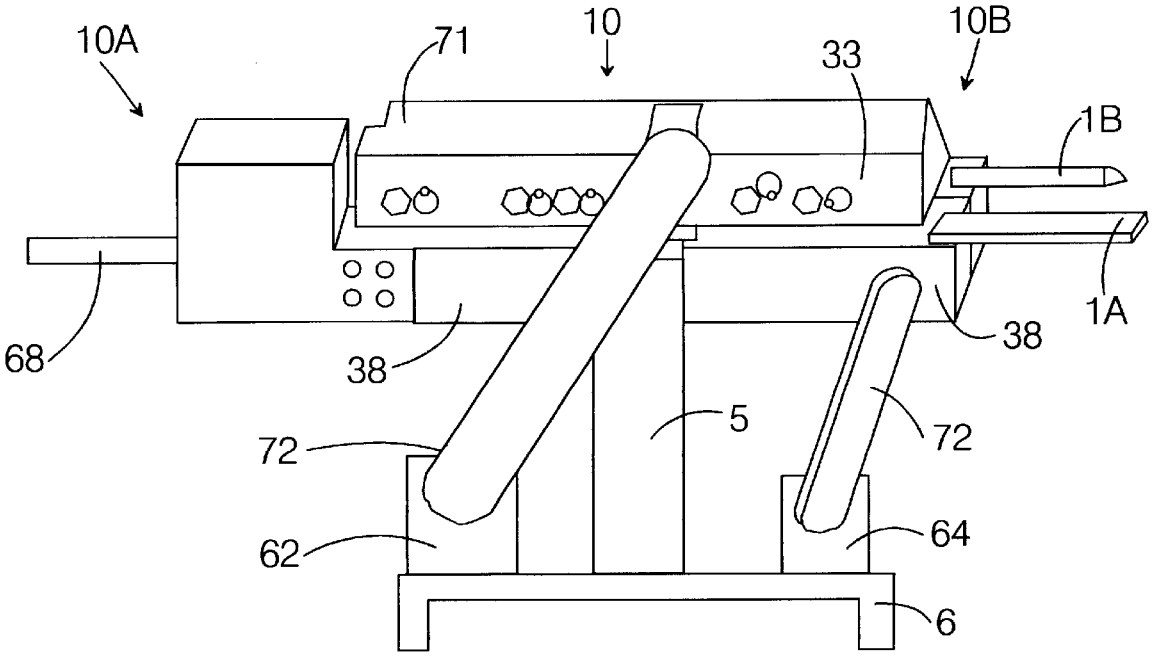
FIG. 9A is a perspective view of the rear of apparatus of the Preferred Embodiment.
Figure 9B:
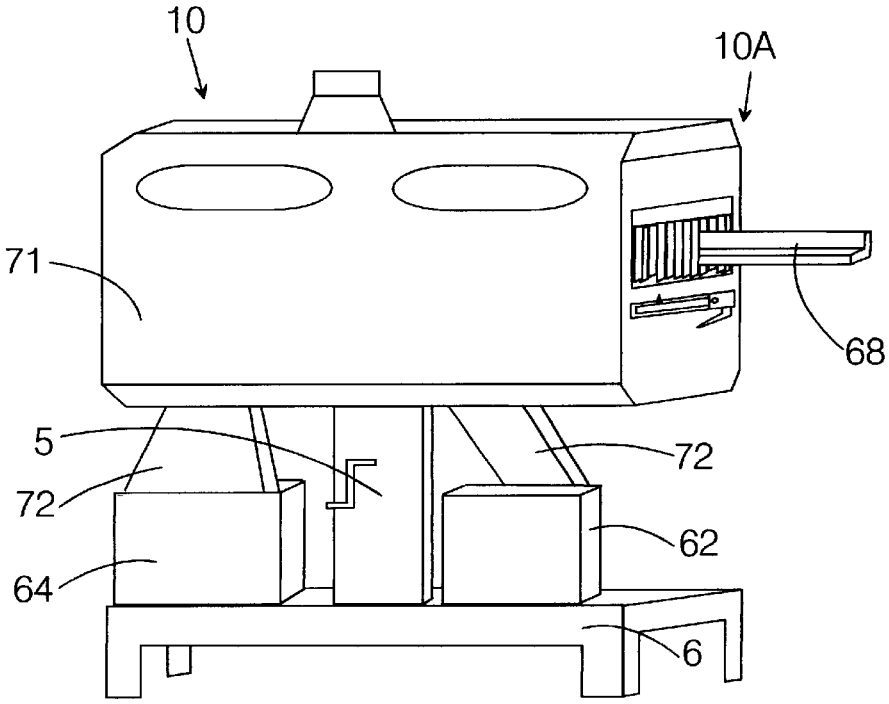
FIG. 9B is a perspective view of the front of the Preferred Embodiment.

FIGS. 9A and 9B show the rear view and the front view, respectively, of the Preferred Embodiment of the recovery apparatus 10, with the housing 33 enclosed in a safety hood 71 and drive belts within belt shrouds 72. Such safety hoods and shrouds are well-known in the art and are not further described herein. As can be seen, a motor 62 drives the tool spindle 3 and a motor 64 the conveyor belts. The sole support and alignment of the housing 33 and the bed 38 of the recovery apparatus 10 is provided by the lifting jack and stabilizing assembly 5, of which only the inner tube 55 and outer tube 56 are visible when the recovery apparatus 10 is in operation.

While a Preferred Embodiment is disclosed herein, this is not intended to be limiting. Rather, the general principles set forth herein are considered to be merely illustrative of the scope of the present invention and it is to be further understood that numerous changes may be made without straying from the scope of the present invention.

What is claimed is:

1. Material-recovery apparatus for recovering a usable product from a workpiece that is remaindered material, said apparatus having an input end, an output end, and a conveyor that extends between said input end and said output end, said apparatus comprising:

a housing, a support bed;

a single tool spindle with a plurality of cutting tools, a single vertical adjustment-and stabilizing unit having a first end and a second end; and a support base having a horizontal base surface;

wherein said vertical adjustment and stabilizing unit is rigidly attached at said first end to said support base and is movably attached at said second end to said housing, wherein said support bed is rigidly mounted on said vertical adjustment and stabilizing unit, and wherein said single tool spindle is mounted on said housing.

2. The material recovery apparatus as described in claim 1, wherein said first end of said vertical adjustment and stabilizing unit includes an outer support tube having a lower outer tube end and an upper outer tube end, and an inner support tube having a lower inner tube end and an upper inner tube end, wherein said lower outer tube end is rigidly connected to said support base and said upper outer tube end is adapted to slidably receive said lower inner tube end, and wherein said upper inner tube end is rigidly connected to said housing.

3. The apparatus as described in claim 2, wherein said housing has a first end and a second end, a length and a longitudinal axis that extend between said first end and said second end, and said vertical adjustment and stabilizing unit has a width, wherein said length of said housing is greater than said width of said vertical adjustment and stabilizing unit and said first end and a second end of said housing are cantilevered out beyond said width of said vertical adjustment and stabilizing unit.

4. The apparatus as described in claim 2, wherein said vertical adjustment and stabilizing unit includes a support-and-alignment bearing, and wherein said inner tube is slidably supported on said support-and-alignment bearing.

5. The apparatus as described in claim 4, wherein said outer tube has an inner surface and said support-and-alignment bearing includes a first bearing surface that is parallel to said inner surface of said outer tube and wherein said inner tube is slidably supported on said first bearing surface so as to be vertically adjustable while remaining in parallel alignment with said outer tube.

6. The apparatus as described in claim 4, wherein said support-and-alignment bearing includes a second bearing surface that is perpendicular to said first bearing surface, and wherein said housing is supported on said second bearing surface so as to maintain a parallel alignment with said base surface.

7. The apparatus as described in claim 4, wherein said support and alignment bearing is a poured bearing of plastic material.

8. The apparatus as described in claim 2, wherein said vertical adjustment and stabilizing unit further includes a single lifting jack for raising and lowering said housing relative to said support bed.

9. The apparatus as described in claim 8, wherein said single lifting jack includes a threaded rod movably mounted in said outer tube, a receiving nut fixedly mounted in said upper tube, and a crank handle mounted on said outer tube, wherein, when said crank handle is turned, said threaded rod is rotated and is engaged in said nut so as to raise or lower said housing relative to said support base.

10. The apparatus as described in claim 9, wherein said single lifting jack further includes a pair of bevel gears having an input gear and an output gear, wherein said input gear is connected to said crank handle and said output gear fixedly connected to said threaded rod.

11. The apparatus as described in claim 1 further comprising:

a material feed unit that includes a feed roller and a tensioning unit, wherein said feed roller is a right cylinder having a first cylinder end, a second cylinder end, a longitudinal roller axis, and a cylindrical side, wherein said feed roller is mounted on said housing and a second cylinder end extends outward from said housing and perpendicular to said length of said housing and parallel to said support bed, and wherein said tensioning unit is connected to said first end of said feed roller and applies a downward force to said feed roller.

12. The apparatus as described in claim 11, wherein said tensioning unit includes a tension shaft having a first shaft end and a second shaft end, a torque disc, a tension spring having a first spring end and a second spring end, a lever, a tension adjustor, and a torque locking device;

wherein said torque disc is rotatably mounted on said first shaft end and said tension spring is wound around said tension shaft and said first spring end is fixedly attached to said torque disc, wherein said second shaft end is connected to said lever and said lever is connected to said first end of said feed roller; and wherein said locking device is inserted into said torque disc to apply a selected amount of downward force to said feed roller.

13. The apparatus as described in claim 12, wherein said material feed unit includes a feed conveyor and a plurality of feed rollers with a corresponding plurality of tensioning units, each feed roller being attached to a respective tensioning unit, and, wherein at least one of said feed rollers is arranged on said housing on an input side of said tool spindle and at least one of said feed rollers is arranged on an output side of said tool spindle.

14. The apparatus as described in claim 13, wherein said plurality of feed rollers includes three input feed rollers are arranged on said input side and two feed rollers are arranged on said output side of said tool spindle.

15. The apparatus as described in claim 1, wherein said plurality of cutting tools includes a horizontal cutter and a sawblade, and wherein said horizonal cutter removes material from a top surface of said workpiece and simultaneously said sawblade removes material from a side surface of said workpiece.

* * * * *